US006825465B2

(12) United States Patent
Schürenberg

(10) Patent No.: US 6,825,465 B2
(45) Date of Patent: Nov. 30, 2004

(54) DISPOSABLE SAMPLE SUPPORT FOR MASS SPECTROMETRY

(75) Inventor: Martin Schürenberg, Tarmstedt (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 10/606,947

(22) Filed: Jun. 26, 2003

(65) Prior Publication Data

US 2004/0084615 A1 May 6, 2004

(30) Foreign Application Priority Data

Jul. 5, 2002 (DE) ..... 102 30 328

(51) Int. Cl.[7] ..... H01J 49/04
(52) U.S. Cl. ..... 250/288
(58) Field of Search ..... 250/288

(56) References Cited

U.S. PATENT DOCUMENTS 5,770,860 A 6/1998 Franzen
6,287,872 B1 9/2001 Schürenberg et al.
6,670,609 B2 * 12/2003 Franzen et al. ..... 250/288
2004/0094705 A1 * 5/2004 Wood et al. ..... 250/288

FOREIGN PATENT DOCUMENTS

GB 2 378 755 A 2/2003

* cited by examiner

*Primary Examiner*—Jack I. Berman

(57) ABSTRACT

The invention relates to the structure of sample support plates for the mass spectrometric analyses of samples with ionization by matrix-assisted laser desorption and ionization (MALDI). The invention consists in combining a very even substructure made from a mechanically stable material with a flush mounted cover made of plastic material of constant thickness to produce a composite sample support plate with a very even surface. The plastic cover is inexpensive to make, must only be used once and helps prevent the substance-memory problem. The surface and material of the plastic cover can be optimized for MALDI. The preferred embodiment of the composite plate has the overall dimensions of a microtiter plate.

25 Claims, 1 Drawing Sheet

DISPOSABLE SAMPLE SUPPORT FOR MASS SPECTROMETRY

FIELD OF INVENTION

The invention relates to the structure of sample support plates for the mass spectrometric analysis of samples with ionization by matrix-assisted laser desorption and ionization (MALDI).

BACKGROUND OF THE INVENTION

Mass spectrometry with ionization by matrix-assisted laser desorption and ionization (MALDI) is now established as a standard method for the analysis of biomolecules. In most cases, time-of-flight mass spectrometers (TOF-MS) are used, but ion-cyclotron resonance spectrometers or radio-frequency quadrupole ion-trap mass spectrometers can also be applied.

The biomolecules are usually in aqueous solution. Here, biomolecules are understood in particular as oligonucleotides (i.e., genetic material in its different forms, such as DNA or RNA) and proteins (i.e., the essential building blocks of the living world), including their particular analogs and conjugates such as glycoprpteins or lipoproteins. Ionization by MALDI can also be used for industrial polymers and small organic compounds. In the following, the molecules being analyzed are referred to as sample molecules or analyte molecules.

The choice of matrix substance for the MALDI process depends on the type of biomolecules. Well over a hundred different matrix substances with their different merits are now known. In particular, the matrix substance must absorb light at the laser wavelength being used, but must also isolate the test molecules from each other in an appropriate manner, convert them into the gaseous phase intact (desorption) and ionize them (usually by protonation or deprotonation). For this task, it has been found to be advantageous to incorporate the analyte molecules in some form into the, in most cases, crystalline matrices as they crystallize on the surface of the sample support or at least into the boundary surfaces between the small crystals which form during the crystallization. There are $10^3$ to $10^5$ times as many matrix molecules as there are analyte molecules.

A range of different methods are known for laying down the sample and matrix. The simplest of these is to pipette a solution of the sample and matrix onto a clean metallic sample support. The drop of solution forms a wetted area on the metal surface. The diameter of the drop is determined by the wettability of the particular metal surface being used. As the solution dries, a sample spot forms which contains tiny matrix crystals within the wetted area. However, the coating on the wetted surface is usually not uniform. With many matrix substances, the tiny crystals are located at the edge of the sample spot. Here, so-called 'hot spots' of high sensitivity form which cannot be recognized as such without testing.

For matrix substances which are either insoluble or only very sparingly soluble in water, such as α-cyano-4-hydroxycinnamic acid, it has been found to be advantageous to produce a very thin layer of crystals on the surface before applying the aqueous analyte solutions, for example by applying a solution of the matrix substance in acetone. In this case, the sensitivity is more uniform over the coating area.

An improved method of laying down the sample is disclosed in the patent specification DE 197 54 978 C1 (GB 2 332 273, U.S. Pat. No. 6,287,872) which consists of applying the samples to small hydrophilic anchor zones in a hydrophobic field. Drops containing the dissolved matrix and dissolved analyte molecules which have been pipetted onto the surface attach themselves to the anchor zones where they crystallize much more uniformly than on surfaces without anchors. The crystalline conglomerates bond strongly to the hydrophilic anchor zones on the surface of the sample support. With careful preparation, it is possible to achieve a sensitivity which is both uniform and reproducible. Here too, it is possible to apply the matrix substances before applying the sample solutions.

All these methods of applying the samples and incorporating them into the tiny matrix crystals are highly dependent on the properties of the hydrophilic anchor zones. These properties include the chemical composition of the sample support at its surface, the oxidation state of the surface, the smoothness of the surface and, in particular, the wetting properties of the surface toward the solvent used. Of crucial importance is that the surface is extremely clean, since the MALDI process can be disturbed by even the tiniest trace of impurities. In particular, no alkali ions must pass from the surface into the dissolved sample. With the usually metallic surfaces of sample supports, reproducible surface structures with the specified properties can only be achieved with great difficulty.

If time-of-flight mass spectrometers are used for the analysis, then the sample supports must also be exceptionally flat. Any twist in the surface must not exceed a few microns otherwise the precise mass determination required to achieve today's accuracies of a few ppm (parts per million) will be more difficult to obtain because of the differences in the length of the flight path. For a flight of one meter, lengthening the flight path by one micron corresponds to an increase in the time of flight of about a millionth and an apparent increase in the mass of two millionths.

So far, only a few types of sample support materials have been found to have a certain degree of universal application. These include, in particular, (1) smooth-rolled, three millimeter stainless steel sheet made by using a special annealing process and with a ground or polished surface, (2) glass plates coated with electrically conductive material, (3) aluminum plates coated with nickel or gold and (4) silicon wafer plates. Since the condition of the surface is of critical importance for the crystallization of the matrix, and different matrices are used according to the application, in practice, different sample support plates are preferred depending on the-application.

For the automated handling of sample support plates, it is advantageous for the plates to have the shape that has become the industry standard for microtitre plates. Commercially available pipette robots can only process sample support plates with the approximate shape of microtitre plates. The plates can be held by standardized grippers and populated with sample droplets using multi-pipette heads. They can be stacked in "plate hotels" or inserted into appropriate magazines like a chest of drawers. The shape of the underside of the microtitre plates acts as a relatively tight, or at least dust-proof, seal for the plate underneath.

The sample support plates can be provided with bar codes on the front or on top. The bar code can be read by various industrial robots. However, it is difficult to develop a printed bar code to withstand a vacuum or washing. For this reason, sample support plates have been developed with vacuum- and wash-proof transponders with readable codes. In some cases, it is even possible to provide the transponder with the current status of the population along with other information.

The use of MALDI sample supports in the shape of microtitre plates for coating with samples from multi-pipetting heads has already been described in the patent specification DE 196 28 178 C2 (corresponding to GB 2 315 329, U.S. Pat. No. 5,770,860).

Many attempts have been made at making sample support plates for use in the MALDI process from plastic. There are a very large number of different plastics. They can be molded extremely cheaply and, with the appropriate fillers, can also be made electrically conductive. It is possible to produce the desired surface textures with a very high level of reproducibility. The surfaces can be metallized, made scratch resistant and made hydrophobic in many different ways. In short, there is hardly any other material with so many possibilities. However, plastics have one crucial disadvantage: they are not resistant to deformation and they go out of shape very easily after molding. Even storage changes their shape. A degree of evenness to within a few microns on larger surfaces is not easily achieved or does not remain stable over long periods.

Nevertheless, the cost-effective manufacture of MALDI sample support plates is still worth striving for. With reusable sample supports, the so-called memory effect can have a negative influence on the measurement results, particularly for applications requiring the highest sensitivity, and certainly for diagnostic applications, since in many cases the analyte molecules cannot be removed quantitatively even with careful washing. Apart from that, there is an increasing demand for test sites which are industrially pre-coated with tested matrix substances of guaranteed purity and function. But further steps in sample preparation on sample support plates, such as enzymic digestion, purification of the test substances or markings, are also approaching and require cheap, disposable sample support plates.

SUMMARY OF THE INVENTION

The basic idea of the invention is a composite sample support with a structure consisting of a reusable substructure made from a mechanically very stable material with the highest dimensional accuracy and a removable plastic cover. Preferredly, the plastic cover is to be used once only. The substructure can be made of materials such as stainless steel, with a surface which is even and dimensionally accurate enough to be used as a MALDI sample support plate. The disposable cover is a plate of uniform thickness made from a relatively thin plastic which is attached so that it lies flush on the substructure. Nowadays it is possible to manufacture plastic plates of uniform thickness and with tolerances of only a few microns on a large scale by injection moulding etc.

Flush mounting can be achieved in different ways. For example, a large number of tags on the plastic plate can be pressed into a large number of undercut holes or grooves in the substructure. However, it is seems better to produce a slightly concave plate with a smooth bottom surface which can be pressed firmly onto the substructure at the edge and will remain flush over a large area due to its elasticity. However, the plastic cover must not be pressed too far over the substructure. The plastic plate can be held at the edges by a separate frame fixed onto the substructure or by a retaining edge on the plastic plate in the form of a solid or perforated strip around the edge which is retained by appropriate ridges or grooves. The grooves can be located on the surface of the substructure or preferably on its end or side surfaces. The precise shape of the edge strip will depend on the hardness and elasticity of the plastic cover.

DETAILED DESCRIPTION

Figure 1:
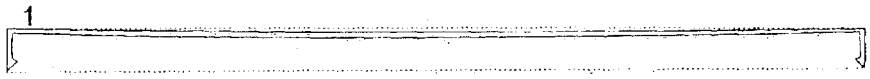
FIG. 1 shows the slightly concave plastic cover (1) before attachment.
Figure 2:
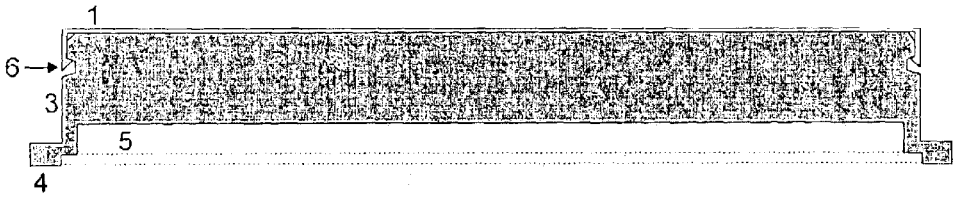
FIG. 2 shows a composite sample support plate with the now flat plastic cover (1) on a substructure (3) with foot (4) and an underside (5) which is shaped as a lid for the sample support underneath. At the position (6), the edge strip is held in a groove in the side wall of the substructure (3).
Figure 3:
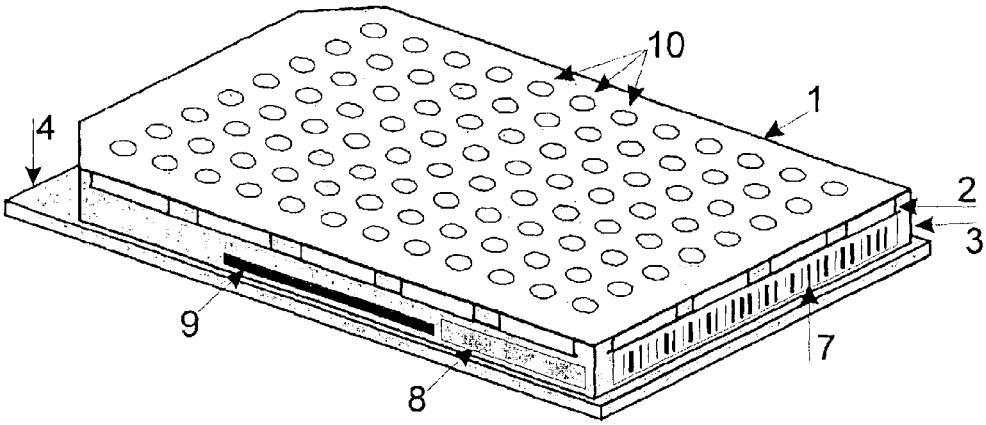
FIG. 3 shows a composite plate in the shape of a microtitre plate. The plastic cover (1) is retained in a groove of the substructure (3) by means of tabs (2). In this case, the substructure has a barcode (7) printed on it, a transponder (8) bonded to it and a recess (9) for a robot arm to hold it by. The test sites (10), which can be pre-coated with the matrix substance, are on the plastic cover (1).

One particularly favorable embodiment of the invention is shown in FIGS. 1 to 3. The sample support has a composite structure with a reusable substructure (3) made out of a mechanically stable material of the highest dimensional accuracy, such as stainless steel, hard aluminum or titanium, and a cover (1) made from an electrically conductive, injection-molded plastic which must only be used once. With some skill and knowledge, a substructure of stainless steel (3) can be made with a surface even enough, and with sufficient dimensional accuracy, to be used as a MALDI sample supports. The cover (1), which must only be used once, is made from relatively thin plastic material and is of very uniform thickness in the area of the support plate. It is attached so that it lies flush on the substructure, reproducing the precision of the stainless steel surface on the outside. Plastic plates of uniform thickness with tolerances of only a few micrometers can be manufactured today very cheaply. It is also possible to give the plastic cover (1) the desired textures with a high level of reproducibility, metallize the surface, make the surface hydrophobic or furnish it with other properties.

In this example, the composite structure has the size and shape of a microtitre plate. When the dimensions of the composite sample support exactly correspond to those of a microtitre plate, it can be easily manipulated by commercially available robots. Other shapes are conceivable, such as those which have been developed for use in commercial mass spectrometers.

The flush mounting illustrated in this example has been achieved by the part of the elastic plastic plate which lies on the substructure being slightly concave, as shown in FIG. 1. The bow in the plastic in its relaxed state amounts to less than half a millimeter. The plastic cover is pressed firmly onto the substructure at the edge, whereby the plastic plate lies flush due to the elasticity of the plastic. A shape established from experience or determined by experiment prevents pressing the cover too far over the substructure. Straightening of the concave surface must not result in the matrix agglomerates, which have been applied to the plate beforehand, springing off the surface.

The hold on the edge can be achieved with a separate frame which anchors itself firmly to the substructure. In the particularly favorable embodiment according to FIG. 3, however, the plastic cover has a retaining edge in the shape of an edge strip with an open structure and tabs (2) which grasp the sides and ends of the substructure and raised edges which snap into the corresponding grooves so that the cover remains firmly pressed onto the surface of the substructure.

The exact shape of the edge strip is determined by the hardness and elasticity of the plastic cover.

With softer plastics, the edge strip can also encompass the plastic plate continuously. It is then able to increase the stability of the plastic plate even without the substructure. This is beneficial both for dispatch and handling. Particularly in this case, the substructure can be perforated and possibly have fine ridges on the surface so that the space between the plastic cover and the substructure can be guaranteed to be evacuated well.

In order to trace the samples accurately, it is beneficial to attach a machine-readable code to the substructure and the plastic cover, possibly by printing a barcode on the surface or a dot code to save space. Since an optical code cannot be attached to the metal surface of the substructure so that it is vacuum and wash proof, it is advantageous to use a permanently integrated transponder. Very simple reading stations are available for these transponders in housings which are vacuum and wash resistant. The codes of the transponders can therefore be read by pipetting stations and appropriately equipped mass spectrometers.

Part of the code in the transponder can be read but not overwritten. This part uniquely identifies the sample support. Another part of the code can be read and overwritten. This part of the code can record data which relates to the individual characteristics of the sample support substructure, the current status of the processing of the samples on the sample support or serve to identify files containing data on the process control of the analytical method relating to the sample. The individual characteristics of the substructure can include wear data, quality classes, adjustment data for the position in the mass spectrometer or similar data such as a use counter. The current status of processing can include the completed coating, the number of coated test sites, the status of the subsequent treatment steps such as washing, recrystallization of the matrix or the analytical steps. In particular, the code can contain the address of a file which contains all the control data for the treatment and analysis. Furthermore, different analytical methods can be used for the individual samples on the sample support plate.

It is not worth integrating a transponder in the disposable plastic cover. However, in order to identify the support, a barcode or dot code can be added during the manufacturing process. Since, where there are transponder reading stations, it is not worth having a separate reading station for this code in all treatment units, a device for fixing the plastic cover to the substructure can also transmit the code for the plastic cover to the transponder at the same time.

If the plastic cover does not have its own identification code, it must only be used once if the rules of "good laboratory practice" (GLP) are to be complied with. To make sure that the cover is only used once, it is possible to provide a special design which prevents the cover from being mounted on the substructure again by ensuring that the support suffers some form of selective damage or kinking.

The shape of the substructure should be such that its underside can be used as a lid for the sample support underneath. The sample supports which have been coated can then be stacked and, in appropriate containers, can be available to supply other treatment units such as the mass spectrometer. The substructure can have special holes or grooves on its edge so that it can be gripped by robots. The substructure must be mechanically stable and the cover must have the appropriate elastic properties to ensure that slight thermal stresses will not result in the whole structure becoming bowed.

The plastic cover is preferably made from electrically conductive material or metallized on the surface so that the acceleration potential of the ions generated in the MALDI process are well defined. Plastics which have been made electrically conductive, for example by using a graphite filler, can now be manufactured cheaply.

As already explained under Prior Art, it is beneficial for the sample support to have a grid with hydrophilic anchors in a hydrophobic field. It is much easier to create this grid on plastics than it is on metallic surfaces. Since the samples sometimes cannot be recognized optically, it is appropriate to attach optically recognized markers to the surface at a fixed distance from the grid. These markers can be used for orientation via a video camera and pattern-recognition software in order for the samples to be accurately placed in the laser focus.

Plastic covers offer many advantages in comparison to the prior art. Plastic surfaces can be made with practically any texture and with any degree of surface tension in respect of water. The cost of manufacturing is low. The use of disposable covers saves repeated washing and helps avoid the so-called memory effect observed with proteins, particularly when the work has to be carried out at the limits of sensitivity. The covers can be prepared with matrix substances on the intended test sites during manufacture. This saves on coating equipment, the procurement of sufficient pure matrix substances and their reproducible preparation. In particular, the plastics can be kept almost completely alkali free—alkali ions lead to adducts and therefore mass errors. They are very difficult to suppress when using metallic sample supports.

The plastic covers can be easily pushed into the grooves of appropriate plastic magazines in packs of approximately 200 to 400 pieces each. One magazine for 400 covers is approximately 25×25×12.5 cm. In these magazines, they can be easily stored under protective gas until they are used. Magazines such as these can be loaded and unloaded by robots.

Grids of tiny spots with coatings which have an affinity for the substance can also be applied beforehand. These 'fish out' the corresponding proteins according to their affinities, for example via antibodies. The proteins can then be washed, eluted and transferred to MALDI spots which are on the same supports.

The surface of the plastic can be made hydrophobic by perfluorination. However, there are also other ways of making the surface hydrophobic, such as applying and fusing perfluoroalkane silicates.

What is claimed is:

1. Composite sample support for the mass spectrometric analysis of samples with ionization by matrix-assisted laser desorption, comprising (a) a mechanically very stable substructure manufactured to a high level of precision and (b) a removable, relatively thin plastic cover of uniform thickness to take up the samples.

2. Composite sample support according to claim 1 wherein the substructure can be used again by removing the plastic cover, whereas the plastic cover is usually used only once.

3. Composite sample support according to claim 1 wherein the plastic cover is fastened to the substructure by special fastening elements.

4. Composite sample support according to claim 1 wherein the substructure is provided with fastening elements which are used to fasten the plastic cover.

5. Composite sample support according to claim 1 wherein the plastic cover has fastening elements which are used to fasten the plastic cover to the substructure.

6. Composite sample support according to claim 5 wherein the plastic cover has a continuous or interrupted edge strip which is used to fasten the edge around the surface of the substructure and is anchored into a groove on the front.

7. Composite sample support according to claim 1 wherein the plastic cover is slightly concave so that it lies flush on the surface of the substructure after being pressed down and secured by the fastening elements.

8. Composite sample support according to claim 1 wherein the substructure has pump channels leading to the surface which ease evacuation of the space between the substructure and the plastic cover.

9. Composite sample support according to claim 1 wherein the substructure carries a machine-readable identifier.

10. Composite sample support according to claim 9 wherein the identifier consists of an optical code.

11. Composite sample support according to claim 9 wherein the identifier is stored in a transponder.

12. Composite sample support according to claim 11 wherein part of the identifier in the transponder contains a permanent code which identifies the sample support and a code which can be overwritten and which may contain data relating to the sample support, the current cover, the processing status of the samples on the sample support, and the files containing data for the process control of the analytical methods relating to the samples.

13. Composite sample support according to claim 1 wherein the plastic cover carries a machine-readable identifier.

14. Composite sample support according to claim 1 wherein the substructure contains holes or grooves on the side to enable the robot to grip the substructure.

15. Composite sample support according to claim 1 wherein the plastic cover cannot be used again after it has been removed.

16. Composite sample support according to claim 1 wherein the outer shape of the composite sample support has the same outer dimensions as a microtitre plate.

17. Composite sample support according to claim 1 wherein the plastic cover is made from an electrically conductive material.

18. Composite sample support according to claim 1 wherein the surface of the plastic cover is metallized.

19. Composite sample support according to claim 1 wherein the plastic cover has a hydrophobic surface.

20. Composite sample support according to claim 1 wherein the plastic cover has a grid of anchor sites, each being more hydrophilic than the surrounding hydrophobic field.

21. Composite sample support according to claim 20 wherein the anchor sites consist of a pre-prepared matrix substance.

22. Composite sample support according to claim 20 wherein the plastic cover contains optically recognizable markers which are located at fixed distances from the anchors.

23. Composite sample support according to claim 1 wherein the sample sites on the plastic cover are pre-prepared and coated with a matrix substance.

24. Composite sample support according to claim 1 wherein sites on the plastic cover consist of chemically functionalized groups.

25. Composite sample support according to claim 1 wherein the substructure contains structures for fitting auxiliary means for removing the plastic cover.

* * * * *